US009108781B2

(12) United States Patent
Albrecht et al.

(10) Patent No.: US 9,108,781 B2
(45) Date of Patent: Aug. 18, 2015

(54) CARTON WITH INTERNALLY ATTACHED LITERATURE WITH FEATURES ENABLING HIGH SPEED CARTON FILLING

(71) Applicants: Kregg Albrecht, Pleasant Prairie, WI (US); Leonard E. Ekdahl, Antioch, IL (US); Robert E. Gaumont, Sun Prairie, WI (US); Dawn Kempf, Fox Lake, IL (US)

(72) Inventors: Kregg Albrecht, Pleasant Prairie, WI (US); Leonard E. Ekdahl, Antioch, IL (US); Robert E. Gaumont, Sun Prairie, WI (US); Dawn Kempf, Fox Lake, IL (US)

(73) Assignee: NOSCO, Inc., Gurnee, IL (US)

( * ) Notice: Subject to any disclaimer, the term of this patent is extended or adjusted under 35 U.S.C. 154(b) by 260 days.

(21) Appl. No.: 13/724,411

(22) Filed: Dec. 21, 2012

(65) Prior Publication Data

US 2013/0161212 A1 Jun. 27, 2013

Related U.S. Application Data

(60) Provisional application No. 61/578,505, filed on Dec. 21, 2011.

(51) Int. Cl.

| | |
|---|---|
| ***B65D 75/54*** | (2006.01) |
| ***B65D 5/48*** | (2006.01) |
| ***B65D 5/70*** | (2006.01) |
| ***B65D 5/42*** | (2006.01) |

(52) U.S. Cl.

CPC ..... *B65D 75/54* (2013.01); *B65D 5/4237* (2013.01); *B65D 5/48014* (2013.01); *B65D 5/48016* (2013.01); *B65D 5/48018* (2013.01); *B65D 5/701* (2013.01)

(58) Field of Classification Search

CPC ..... B65D 75/54; B65D 5/48016; B65D 5/48018; B65D 5/4237; B65D 5/48014; B65D 5/701

USPC ..... 206/232, 460, 784, 831; 229/120.02, 229/120.08, 120.18, 120.21, 244

See application file for complete search history.

(56) References Cited

U.S. PATENT DOCUMENTS

| | | | | |
|---|---|---|---|---|
| 3,147,856 | A * | 9/1964 | Lightner et al. | 206/232 |
| 4,294,397 | A * | 10/1981 | Kohler | 229/120.08 |
| 5,366,141 | A * | 11/1994 | Stone | 229/120.18 |
| 6,702,108 | B2 * | 3/2004 | Lo Duca | 206/232 |
| 6,913,140 | B2 * | 7/2005 | Lo Duca | 206/232 |
| 6,923,366 | B2 * | 8/2005 | Lo Duca | 229/120.18 |
| 7,036,715 | B2 * | 5/2006 | Lo Duca | 229/120.18 |
| 7,726,549 | B2 * | 6/2010 | Lo Duca | 229/120.18 |
| 2002/0117409 | A1 * | 8/2002 | Okin et al. | 229/120.18 |
| 2004/0020977 | A1 * | 2/2004 | Lo Duca | 229/120.18 |

* cited by examiner

*Primary Examiner* — Luan K Bui
(74) *Attorney, Agent, or Firm* — Schiff Hardin LLP

(57) ABSTRACT

A product container formed from a continuous blank that permits the inclusion of literature from the product manufacturer or packager. The container contains structures that prevent the included literature from interfering with high-speed, automated filling of products into the container.

7 Claims, 11 Drawing Sheets

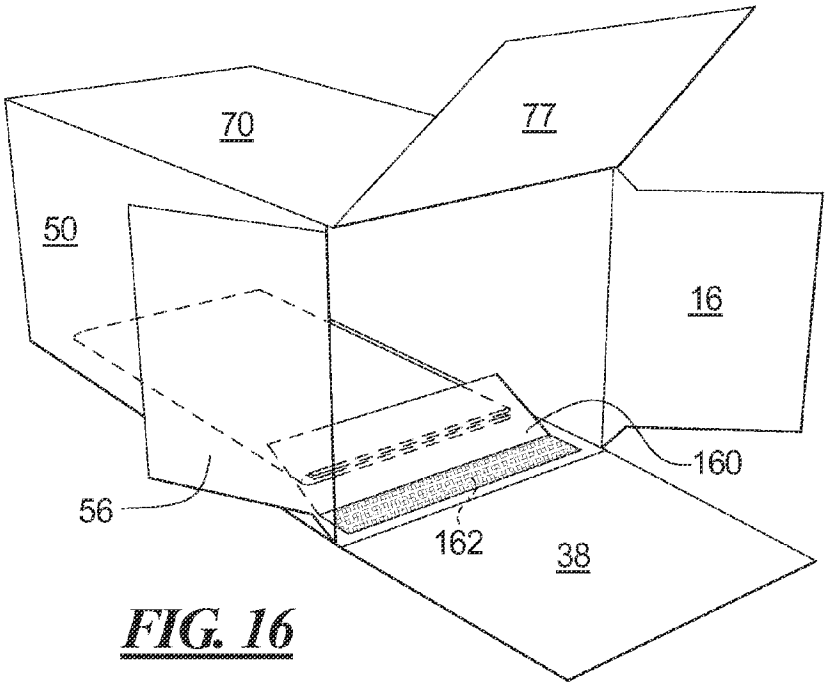
FIG. 16
FIG. 15
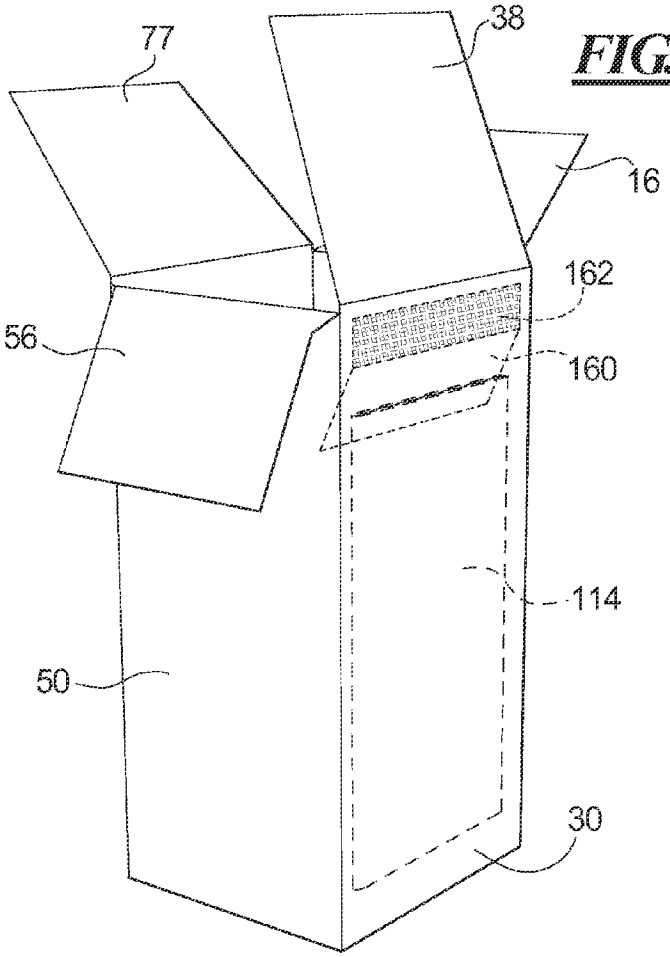

CARTON WITH INTERNALLY ATTACHED LITERATURE WITH FEATURES ENABLING HIGH SPEED CARTON FILLING

CROSS REFERENCE TO RELATED APPLICATION

The present non-provisional application claims the benefit of provisional patent application Ser. No. 61/578,505 filed Dec. 21, 2011, which is incorporated herein by reference.

FIELD OF THE INVENTION

The present invention relates to folding cartons used for product packaging. More specifically, the invention is to a folding carton that makes the literature insertion process more efficient and less prone to assembly line down time.

BACKGROUND

Folded cartons supplied to the public typically have, on their outer surfaces, printed information—product usage instructions, warnings, indications, directions for use and other types of information. This printed information on the outside of the carton suffers from the limited surface area that can be provided on the outer surface of a carton which is inadequate in those situations where detailed instructions, federal, state or locally required information, or in the case of pharmaceuticals, patient directions for use, drug facts or other important information, must be provided. In these situations additional literature is often added to the inside of the carton by the manufacturer on their packaging line.

The typical carton and literature insertion process is as follows: Cartons are glued and folded by the folding carton manufacturer with the carton end flaps left unglued. They are shipped to the manufacturer of the product to be packaged, erected by this manufacturer, filled with the product and then the literature is placed into the package just before the carton end flaps are glued and closed. Arrangement of the literature inside the carton is important to the manufacturer filling the carton with product. The literature must be placed inside the carton in a position that allows for easy removal of the product and the literature. The current process of filling a carton with both literature and product is a complex packaging operation. During insertion of the literature and product into the carton they collide and interfere with each other causing line stoppages.

There are various methods for increasing copy space on or in a carton. One alternative is to include a loosely folded sheet of literature inside of the carton. This method can provide adequate information space. However, the literature is likely to be disposed of after opening of the package. Pharmaceutical packages in particular require that the important information be available to the patients when they take their medication.

In addition, this normally supplied literature inside the carton must be inserted into the package either by hand or by automated equipment in the carton filling production or packaging line during the manufacture of the product. This literature insertion step by the product manufacturer is a known cause of line downtime, increased waste and a loss of revenue. The literature insertion equipment is costly to install and maintain, and is often a limiting factor in productivity on a filling or packaging line.

Another known method for increasing copy space on or in a carton is to attach folded literature to the outside of the carton. This makes the literature susceptible to damage, accidental removal during handling and transport and detracts from the aesthetics of the outer carton.

Still another method is a carton with a fifth and/or sixth panel which wraps around the typical exterior of the carton providing additional information space. The disadvantages of a fifth/sixth panel carton include: higher material costs, limited space compared to folded literature, additional complexity for senior citizens, and they can be difficult to open for people with limited use of their hands such as the elderly or those with arthritis.

Another method would include the customer attaching literature to the inside of a carton on their filling and/or packaging lines. This is problematic since the literature attached to the inside of the carton, prior to the carton being filled with product, must be folded down to very small dimensions and is typically bulky and protrudes into the inside of the carton causing interference and making automated high speed product insertion difficult or impossible.

A primary objective of this invention is to provide a carton with attached literature that simplifies the step of enclosing the literature from the product manufacturer or packager. Another primary objective is to provide a carton with attached literature inside that allows the product manufacturer or packager to achieve high-speed, automated filling of products into the carton without the attached literature interfering with insertion of the product during the carton filling, closure and gluing process.

The invention describes methods of forming folding carton styles that protect literature attached by the carton manufacturer from interfering with the high speed automatic insertion of product into the folding carton.

BRIEF DESCRIPTION OF THE DRAWINGS

FIG. 15 is a projection view of the carton containing literature attached to the panel area formed from the layout of FIG. 14 showing the applied label partially overlapping the edge of the literature;

FIG. 16 is an isometric side view of the literature attached inside of the carton from the layout of FIG. 14 with the applied label partially overlapping the edge of the literature;

DETAILED DESCRIPTION OF THE PREFERRED EMBODIMENTS

Various embodiments now will be described more fully hereinafter with reference to the accompanying drawings, which form a part hereof, and which show, by way of illustration, specific embodiments. However, this invention may be embodied in many different forms and should not be construed as limited to the embodiments set forth herein. Rather, these embodiments are provided so that this disclosure will be thorough and complete, and will fully convey the scope of the invention to those skilled in the art. The following detailed description is not to be taken in a limiting sense.

Throughout the specification and claims, the following terms take the meanings explicitly associated herein, unless the context clearly dictates otherwise. The phrase "in one embodiment" does not necessarily refer to the same embodiment, although it may. Furthermore, the phrase "in another embodiment" does not necessarily refer to a different embodiment, although it may. Thus, as described below, various embodiments of the invention may be readily combined without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

In the following description, the same numbers are used to describe parts having corresponding functions in different embodiments. The parts with the same numbers are not and need not be identical, although in some instances they may be identical in some aspects.

The present invention discloses several methods of enclosing literature within a carton formed from a folded blank such that the literature does not interfere with the insertion of customer product. As used herein, the term "literature" means any type of regulatory materials, marketing materials, coupons, membership cards, product promotions, medical usage literature, instructions or other written materials that may accompany products that are sold to consumers. The term "customer product" means any type of product that is shipped, sold or otherwise delivered to a consumer and that is shipped within a box container or carton. A square shape for sides or ends of a carton is intended to fall within the definition of rectangular.

Embodiment #1

Figure 1:
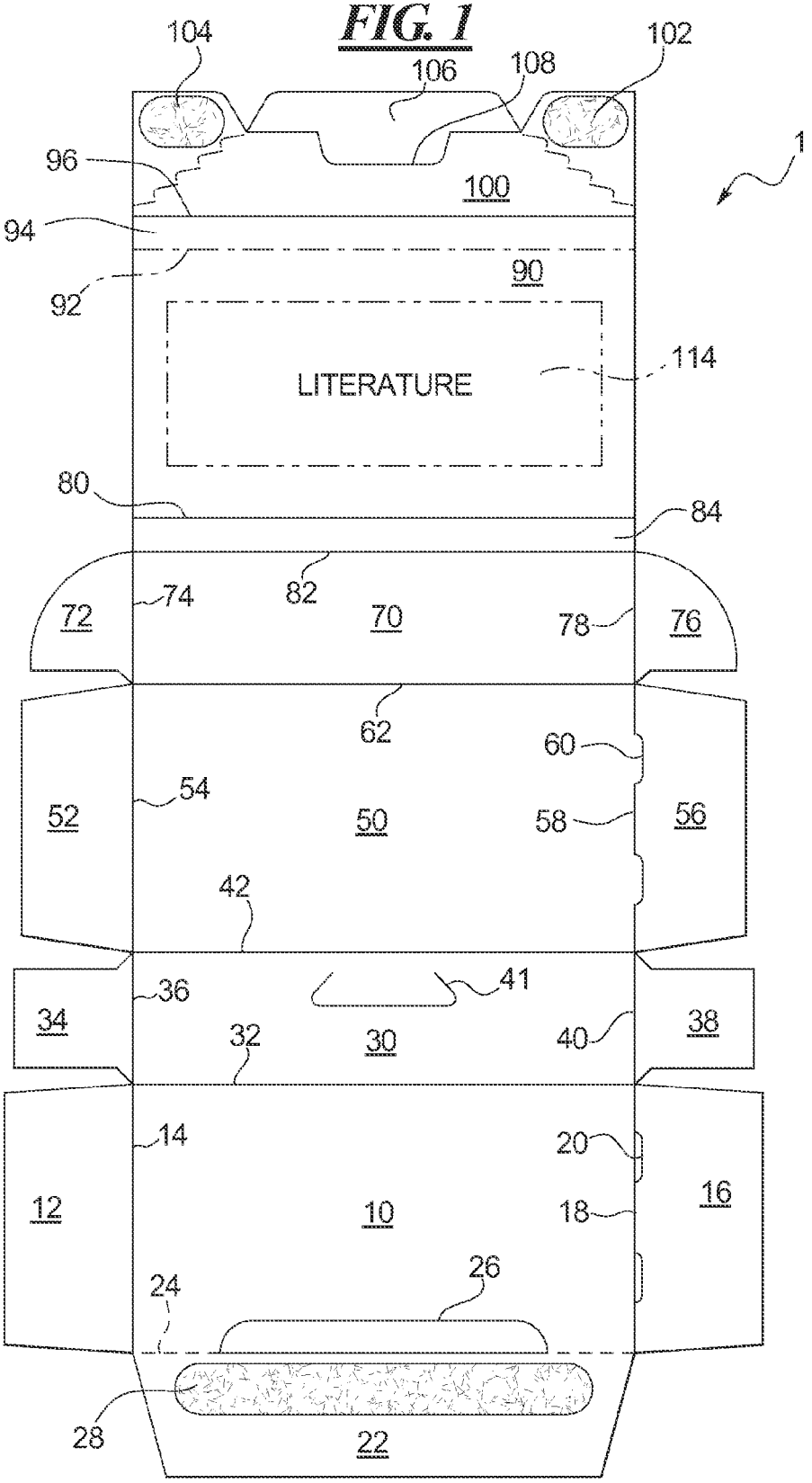
FIG. 1 is a layout view showing cut and fold locations of a flat that can be folded to form a fifth panel carton with a location to attach literature.
Figure 3:
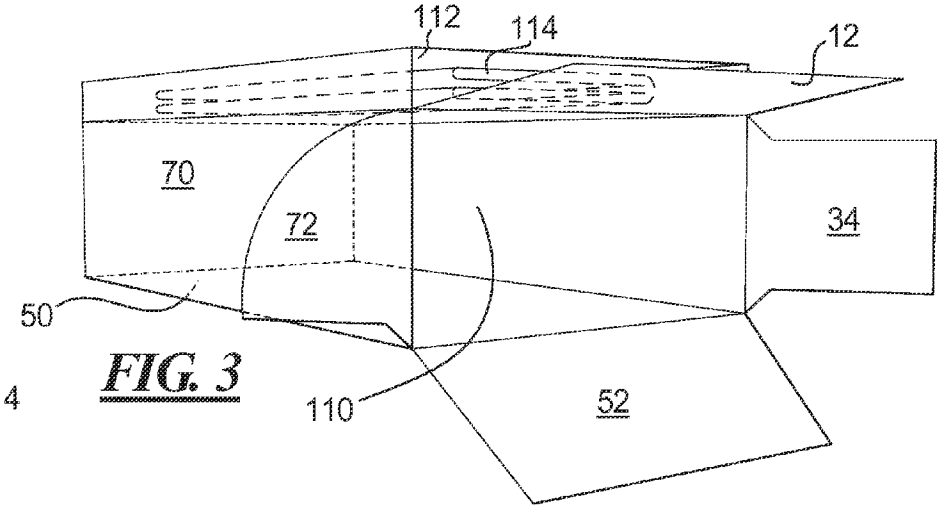
FIG. 3 is an isometric side view of the literature attached inside of the fifth panel from the layout of FIG. 1.
Figure 4:
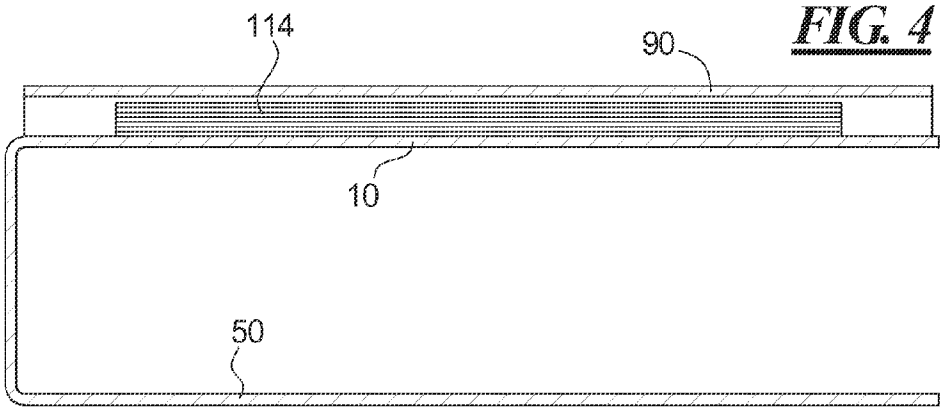
FIG. 4 is a side section view of the attached literature enclosed inside the fifth panel from the layout of FIG. 1.
Figure 2:
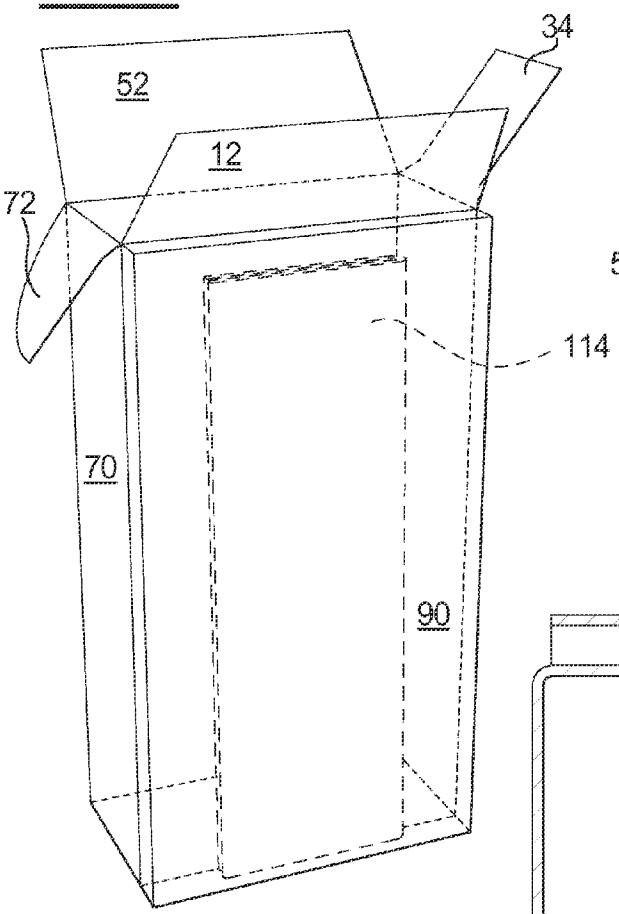
FIG. 2 is a projection view of the carton containing literature attached to the fifth panel area formed from the layout of FIG. 1.

A first embodiment of the present invention is shown in FIGS. 1 through 4. FIG. 1 shows six panel carton 1 in the unfolded state. The configuration of six panel carton 1 may be created from a blank or flat by die cutting and creasing and/or marking or any other suitable method. The blank or flat may be comprised of paperboard, plastic, cardboard, cardboard laminate, or similar materials.

Six panel carton 1 is typically a single piece of material that is partitioned into four side panels 10, 30, 50, 70, fifth panel 90 and sixth panel 100. The panels are respectively formed in the blank or flat by creasing and/or marking for folding, pre-folding and/or folding along pre-defined fold lines. Fold line 32 separates side panel 10 from 30, fold line 42 separates side panel 30 from 50, fold line 62 separates side panel 50 from 70, fold line 82 separates side panel 70 from fifth panel 90 and fold line 92 separates fifth panel 90 from sixth panel 100.

Side panel 10 is formed with end panels 12, 16 by fold lines 14 and 18, and side panel 50 is formed with end panels 52, 56 by fold lines 54, 58, respectively. Side panel 30 is formed with flaps 34, 38 formed by fold lines 36, 40, and side panel 70 is formed with flaps 72, 76 by fold lines 74, 78, again respectively. Side panel 10 also is separated from side flap 22 by fold line 24.

In forming six panel carton 1 into its assembled state, side flap 22 is folded along fold line 24 so that side flap 22 is perpendicular to side panel 10. Side panel 30 is folded along fold line 32 so that side panel 30 is perpendicular to side panel 10 and parallel to side flap 22. Next, side panel 50 is folded along fold line 42 so that it is perpendicular to side panel 30 and parallel to side panel 10. Finally, side panel 70 is folded along fold line 62 so that side panel 70 is perpendicular to side panel 50, parallel to side panel 30 and co-planarly adjacent to side flap 22. Adhesive may be placed in region 28 of side flap 22 to fixedly hold side flap 22 against side panel 70. The adhesive or glue used in constructing the carton is typically a cold liquid glue. However, a hot melt glue can also be used. One end of six panel carton 1 may be sealed by closing the end panels and flaps at that end of the carton. For example, flaps 34, 72 and end panels 12, 52 may be folded along the fold lines that connect the flaps and end panels to the respective carton side panels to close off one end of the carton, leaving the other end of the carton open so that it can be filled during assembly of the final product.

In attaching side flap 22 to side panel 70, panel extension 84 extends beyond the plane formed by side panel 10 as it intersects with side panel 70. Fifth panel 90 is then disposed separated from but coplanar with side panel 10 by a right angle fold along fold line 80. Sixth panel 100 then extends back toward side panel 10 by a right angle fold along fold line 92, so that sixth panel 100 is adjacent to and coplanar with side panel 30, leaving a distance equal to panel extension 94 between side panel 90 and side panel 10. The space between the side panels 10 and 90 form a compartment within which literature, such as information on a medication, instructions, or other literature may be placed. Adhesive may be placed in regions 102 and 104 (on the back side of the six panel carton 1 as shown in FIG. 1) to connect together sixth panel 100 and side panel 30.

As apparent, two separate compartments, one entirely enclosed and the other open at the ends, are formed by six panel carton 1. First compartment 110 (FIG. 3) is formed by side panels 10, 30, 50 and 70 on the sides and enclosed by end panels 16, 56 on one end and end panels 12, 52 on the other end. Second compartment 112 is formed by sixth panel 100, side panel 10, panel extension 84 and panel extension 94 on the sides, with openings at the opposite ends. Second compartment 112 may contain literature insert 114, which may be held in place by an adhesive. The adhesive used in attaching the literature is preferably a glue or adhesive that has the property of preventing fiber-tear of the insert on removal by the end user. For example, the adhesive may be a peel-away adhesive that enable the literature to be removed without damage.

The illustrated carton has features enabling the product manufacturer to fill the carton with a product while avoiding interference with the literature. For example, the end panels 16 and 56 and the end flaps 38 and 76 are left open when the carton is to be filled. A product, such as medication or other product, may be inserted into the interior space of the carton regardless of whether the literature is present in the separate literature space 112 defined by the sixth panel 100 and side panel 10 or not. The separate literature compartment 112 can be filled with the literature before insertion of the product into the compartment 110 or the separate literature compartment can be filled with the literature after the product has been inserted into the compartment 110. In either instance, the insertion of the product does not have interference from the literature and the insertion of the literature does not have interference from the product. In a preferred embodiment, the literature is inserted first and adhered in place during assembly of the carton. The product is inserted thereafter.

The carton ends 16 and 56 are provided with cuts 20 and 60, respectively, that are out of line with the fold lines 18 and 58. These cuts facilitate folding of the carton ends by automated box filing and closing machines. The flaps 38 and 76 are of course closed prior to closing the carton ends 16 and 56.

The present carton provides easy opening features for the end user. For instance, the tab 106 on the sixth panel 100 may be grasped by the user and pulled away from the side 30. The adhesive at the regions 102 and 104 cause the corners of the panel 100 to remain attached to the side 30 and the center portion of the panel 100 to tear loose along the diagonal perforations that extend from the ends of the tab 106 to the ends of the line 96. The result is that the panel 90 may be pivoted open away from the side 10 to provide access to the literature by the user. The user may remove the literature such as by peeling the literature from the panel or side that it is adhered to by the peel-away adhesive.

The separate literature compartment can be reclosed by positioning the panel 100 at the side 30 and inserting cut-out tab 108 of the panel 100 into slit 41 of the side 30. To facilitate insertion of the tab 108 into the slit 41, the tab 106 may be pivoted or folded along the fold line extending from the ends of the tab 108 to cause the tab 108 to extend from the plane of the panel 100 and into the slit 41.

The user may also open the carton to remove the product using the tear-away tab 106. For example, after the tab 106 is pulled from the side 30 and the literature compartment has been opened, the panel 90 can be pulled to cause the fold 24 between the side 10 and the flap 22 to tear so that the carton interior is accessible. The cut 26 that extends along a majority of the fold line 24 facilitates tearing along the fold line 24 by decreasing the length of the tear. The tearing along the fold line 24 is a result of the adhesion between the flap 22 and the side 70 caused by the adhesive patch 28. Tearing of the flap 22 may be facilitated by grasping the tab formed by cut 26. It is foreseeable that the adhesive patch 28 may separate prior to tearing of the fold 24. In this case, the flap 22 may be lifted to access the interior of the carton. The flap 22 may also be torn loose along fold 24 after separation of the adhesive patch 28, if desired.

Once the carton is opened, either by tearing the fold 24 or separation of the adhesive 28, the side 70 may be pivoted to an open position to provide access to the carton interior. Pivoting movement of the side 70 away from the carton structure is facilitated by the curved edges of the flaps 72 and 76, which enable the flaps 72 and 76 to slide in an arc in the end of the opening of the carton without binding as would be the case with rectangular flaps.

Even after opening of the carton by tearing the fold or separating the adhesive, the carton can be reclosed, such as by folding the panel 90 back over the side 10 and inserting the tab 108 into the slit 41.

Thus, the carton provides for interference-free filing of the product into the carton without the literature being in the way. The user may easily open the carton and reclose it after opening. The user may open just the literature compartment without opening the product compartment, or the user may open both compartments. The carton may be reclosed by the user and secured in the closed position regardless of whether the user has opened one or both compartments.

Of course, the end flaps and possibly other portions of the carton may receive adhesive as well to hold the carton closed. These commonly known adhesive locations, for the present embodiment as well as for the following embodiment, are not shown but will be understood by those of skill in this field.

Embodiment #2

FIGS. 5 through 8 illustrate a six panel carton forming an internal partition for literature according to a second embodiment of the invention. The configuration and assembly of side panels 10, 30, 50 and 70 are in many ways similar to that shown and described in embodiment 1 above. The differences are highlighted below.

On assembly, internal fifth panel 120 is folded along fold line 80 so that the panel 120 extends at a right angle to side panel 70 whereby when the carton is assembled the panel 120 is disposed adjacent to and parallel to the plane formed by side panel 10. Adhesive is placed in region 124 to bond internal fifth panel 120 to side panel 10. Internal sixth panel 130 is folded along fold line 122 so that internal sixth panel 130 is perpendicular to internal fifth panel 120 and parallel but spaced apart from side panel 30. Side flap 134 is folded along fold line 132 and bonded through adhesive placed in region 136 to side panel 50. The distance from the fold 80 to the fold 122 is less than the fold lines that define the sides 10 and 50. As a result, the fifth panel 120 forms an internal partition within the carton. The internal fifth panel 120 includes curved cut-outs at two opposite ends that provide clearance for access to literature placed within a literature area of the carton.

Figure 5:
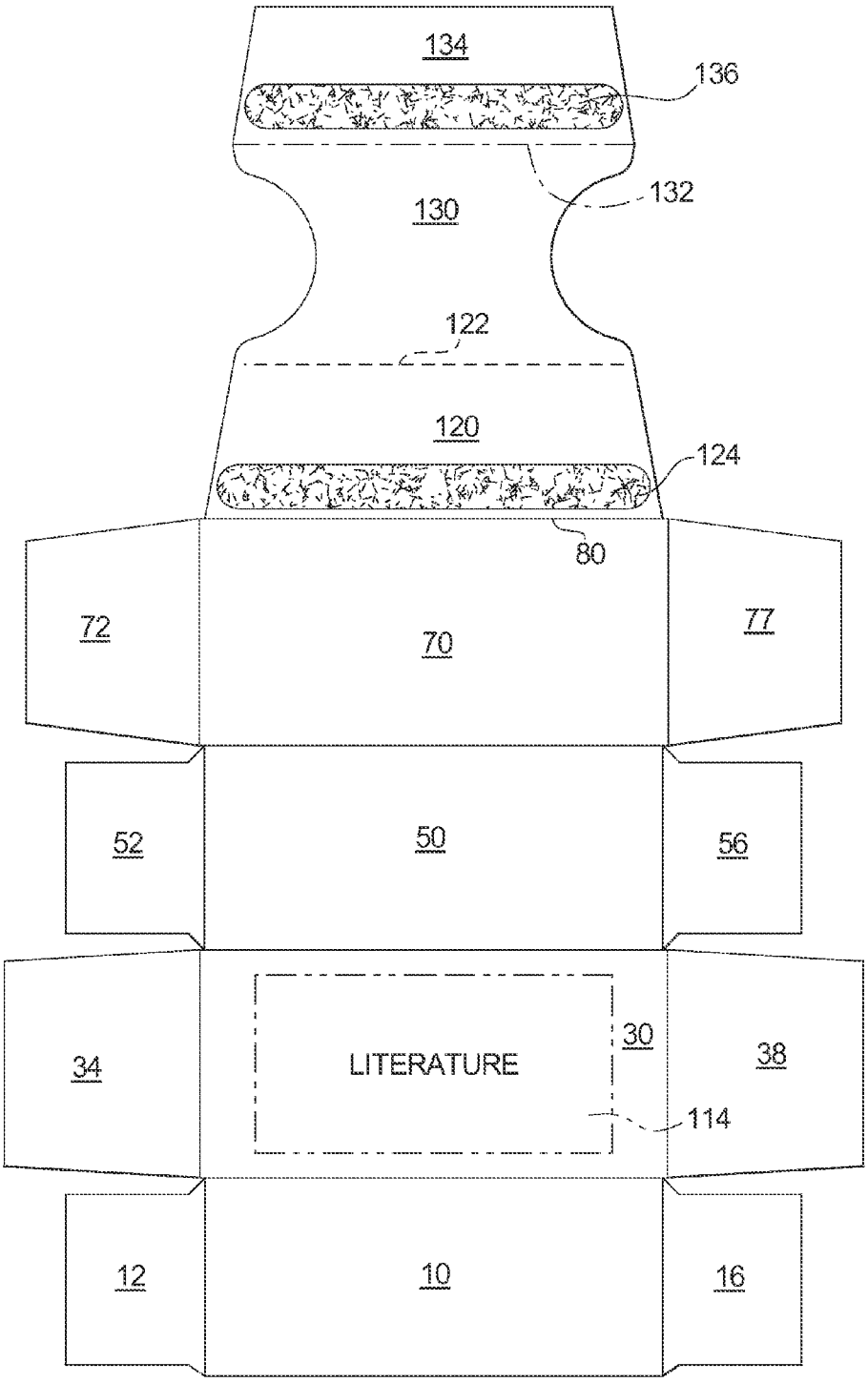
FIG. 5 is a layout view of a flat that has been cut and that can be folded to form an internal partition intended to hold attached literature away from product contact and interference during product filling.
Figure 7:
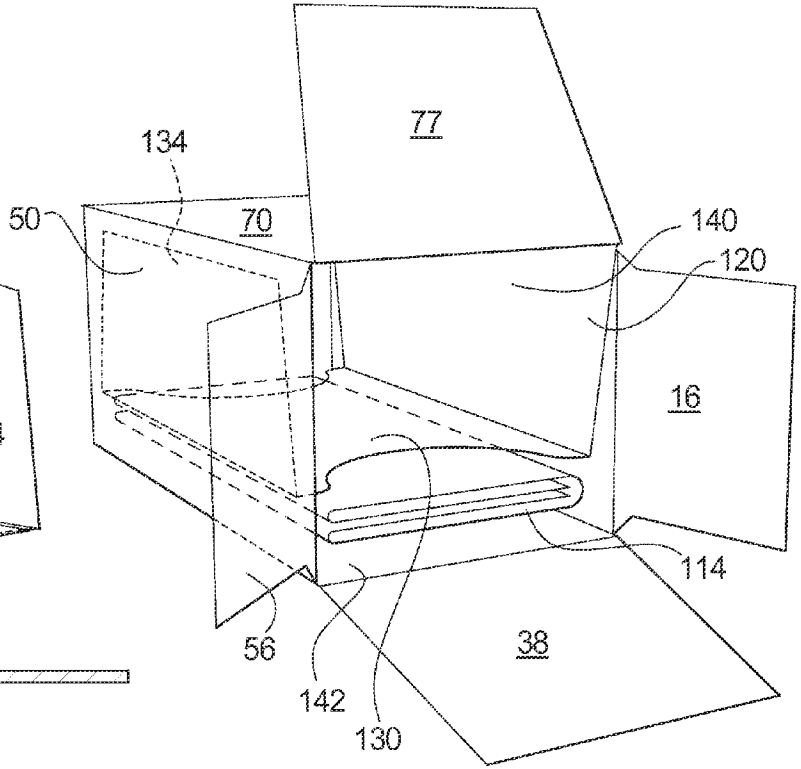
FIG. 7 is an isometric side view of the literature attached inside of the internal partition from the layout of FIG. 5.
Figure 6:
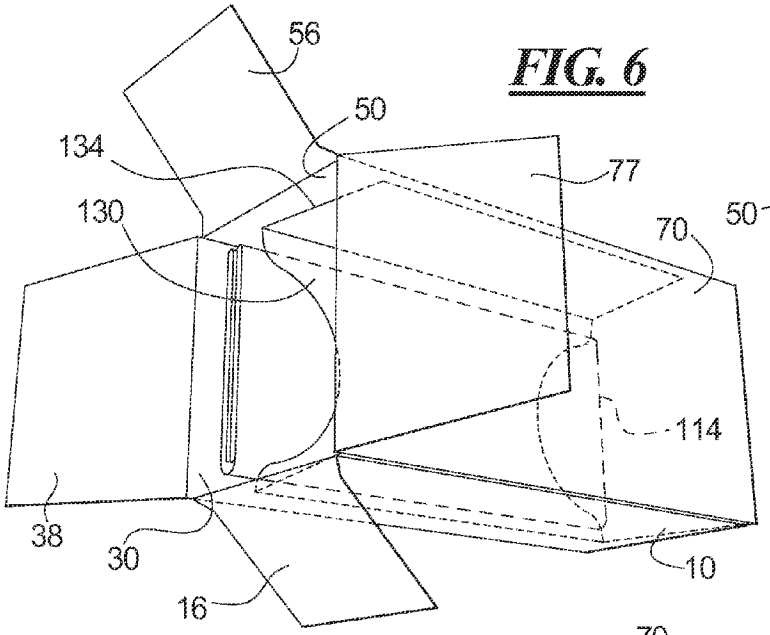
FIG. 6 is a projection view of the carton containing literature attached to the internal partition area formed from the layout of FIG. 5.
Figure 8:
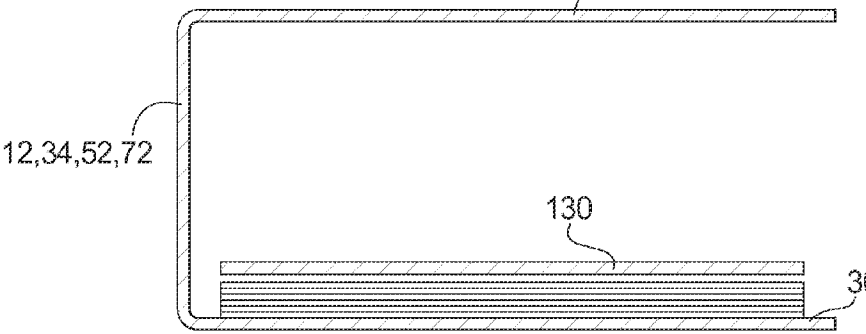
FIG. 8 is a side section view of the literature enclosed inside the internal partition from the layout of FIG. 5.
Figure 9:
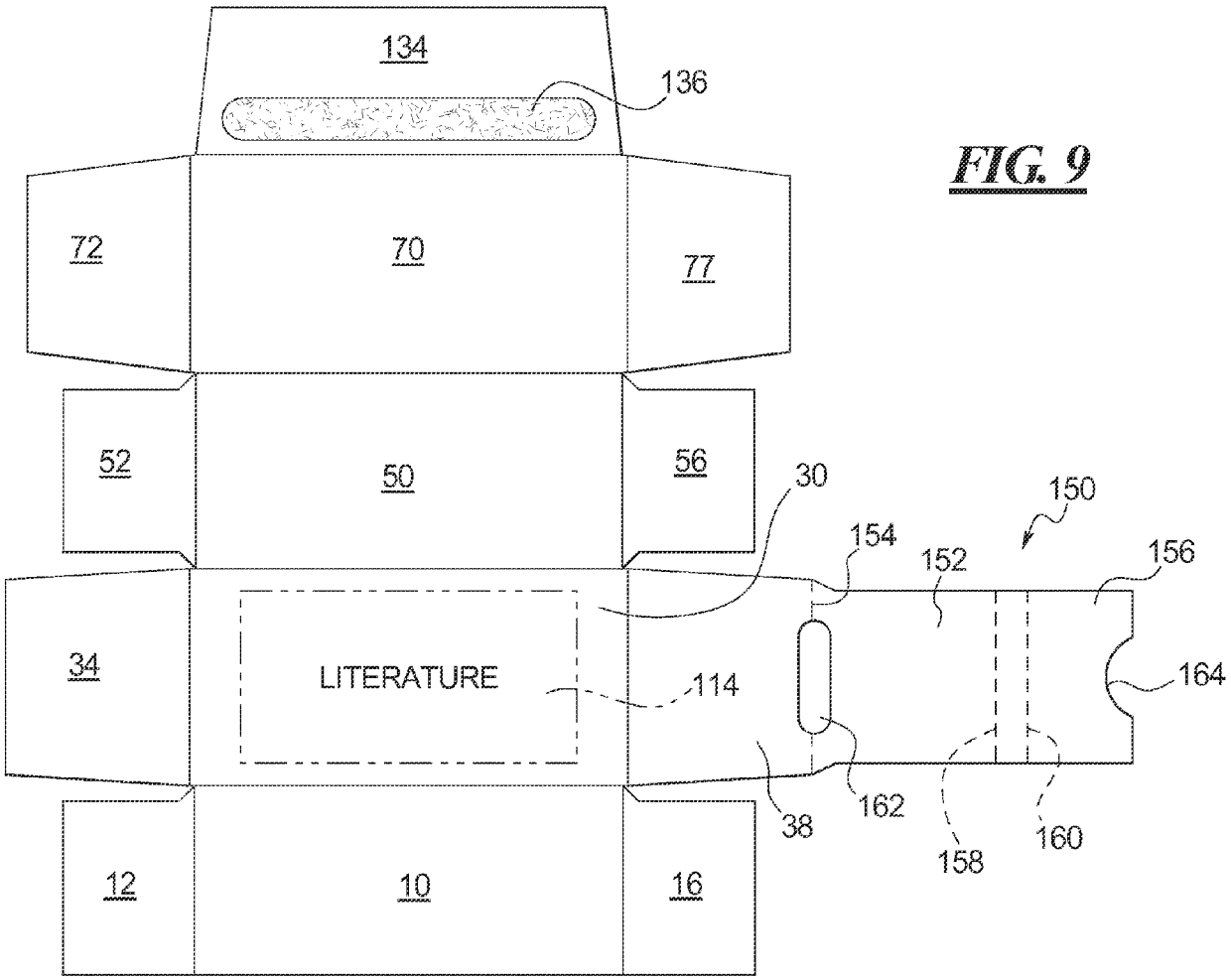
FIG. 9 is a layout view of a flat that has been cut and that can be folded to form an internal ramp intended to direct the product being inserted away from the attached literature and preventing the literature from interfering with the product insertion.

Two sections, both internal, are formed in this embodiment. First compartment 140 (FIG. 7) is formed by side panels 50, 70, internal fifth panel 120 and internal sixth panel 130, with end panels 38,77 on one end and end panels 37, 72 on the other end. Second compartment 142 is formed by side panels 10, 30, 50 and internal sixth panel 130, with end panels 38, 77 on one end and end panels 37, 72 on the other end. Literature 114 may be placed, with or without adhesive, within the enclosed carton within section 142. As can be seen in FIG. 7, a product may be readily inserted into the carton without interference from the literature, even if the literature is already provided in the carton prior to insertion of the product. As noted earlier, the literature may be inserted prior to insertion of the product into the carton or after insertion of the product into the carton. The internal fifth panel 120 which divides the literature compartment from the product compartment may have the curved cut-outs on one end or on both ends (as shown in FIG. 5) or may have no curved cut-outs (as shown in FIG. 7). The ends of the fifth panel may be set back from the ends of the carton. The user may thereby grasp and remove the literature that has been placed into the literature compartment.

Embodiment #3

FIGS. 9 to 13 illustrate another embodiment of a carton forming an internal partition for literature. The configuration and assembly of side panels 10, 30, 50 and 70 are in many ways similar to those of embodiments 1 and 2 above. Side flap 134 is attached through adhesive in region 136 to side panel 10, and the ends of the carton are closed by flaps 12, 16, 52, 56 and end panels 34, 38, 72, 77.

Figure 11:
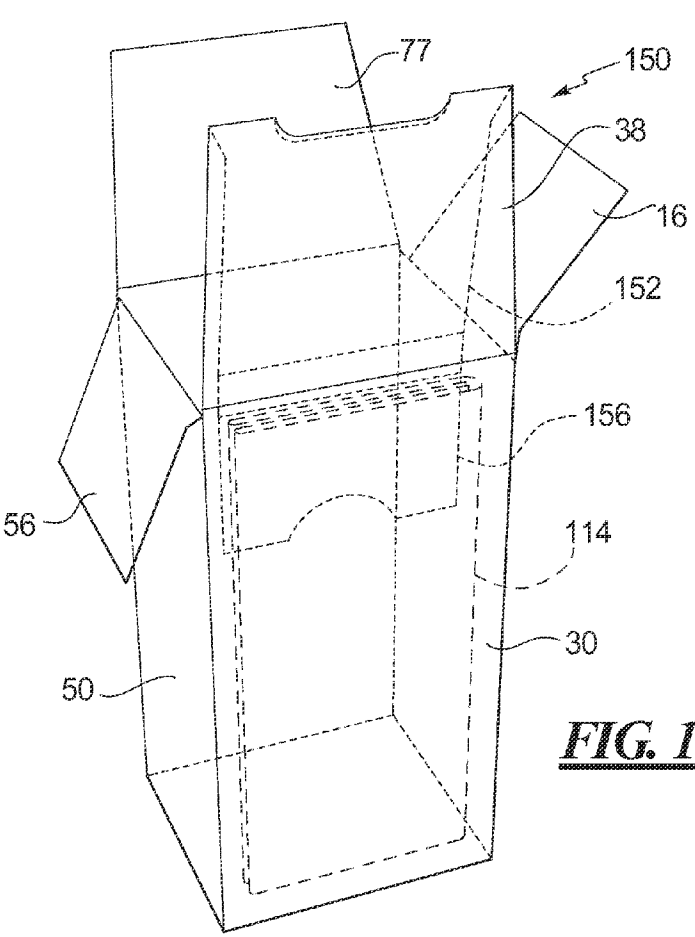
FIG. 11 is a projection view of the of the carton containing literature attached to the inside of the carton with the internal ramp folded into its functioning position formed from the layout of FIG. 9.
Figure 10:
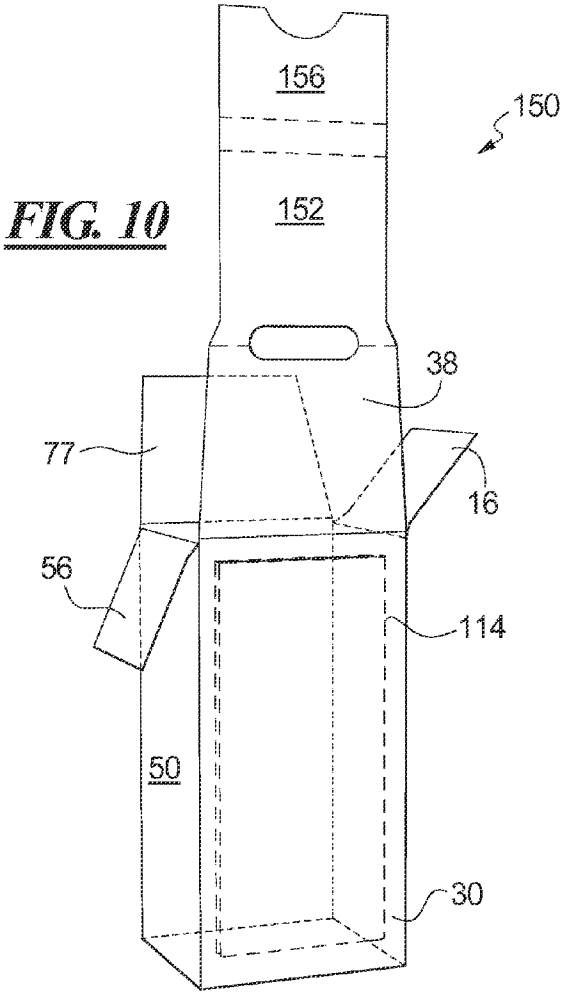
FIG. 10 is a projection view of the carton containing literature attached to the inside of the carton before the internal ramp is folded into its functioning position formed from the layout of FIG. 9.
Figure 12:
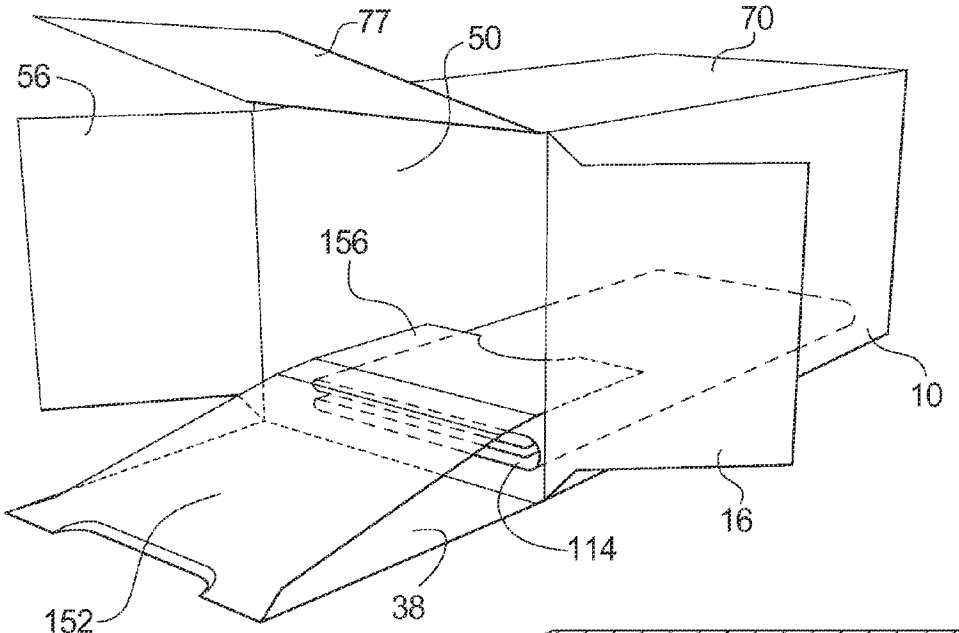
FIG. 12 is an isometric side view of the literature attached inside of the carton with the internal ramp with the ramp covering the attached literature from the layout of FIG. 9.
Figure 13:
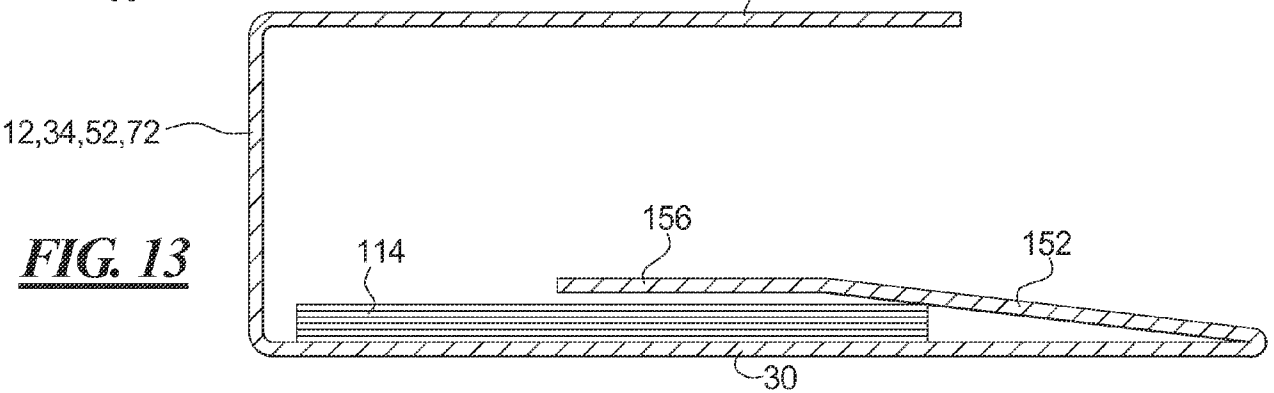
FIG. 13 is a side section view of the literature enclosed inside of the carton with the internal ramp from the layout of FIG. 9.

In this embodiment, end panel 38 is connected to internal partition 150 by fold line 154. Internal partition 150 may contain sections 152 and 156 separated by fold lines 158 and 160. Internal partition 150 may have cutout 162 at the fold line 154 and second curved cutout 164 at the end of the end panel 150 for ease of handling during assembly and filling of the carton. On assembly, while the end of the carton having end panel 38 is in the open position, internal partition 150 is folded back along fold line 154 so that section 156 is disposed within the internal cavity of the carton as shown in FIGS. 11 and 12. Literature 114 may be placed or secured within the cavity on the inside of side panel 30. Internal partition 150 forms a ramp over literature 114 so that literature 114 is prevented from interfering with the carton filling process. The product being introduced into the carton slides along the ramp and the edge of the literature does not catch on the product during insertion.

Once the carton is filled, end panel 38 and the other end flaps on that end of the carton may be moved to their closed positions to close the carton. For example, the portion of the panel 38 attached at the fold to the side panel 30 is folded to approximately a right angle to the side panel 30 to close the end of the carton. The section 152 is initially nearly parallel with the portion 38 while serving as a ramp and remains nearly parallel with the portion 38 during and after the folding process. The section 156 lies against the literature 114 during filling of the product and remains against the literature during and following folding of the portion 38. The double folds 158 and 160 accommodate the presence of the literature in the carton and help prevent binding as the portion 38 is folded over. For instance, the fold 158 when the portion 38 is folded closed is adjacent the fold between the side panel 30 and the portion 38 and lying against or nearly against the side panel 30. The narrow portion between the folds 158 and 160 extends from the side panel 30 to the surface of the literature between the literature and the product. In a preferred embodiment, the narrow portion is at least as wide as the literature is thick. The end portion 156 lies between the literature and the product. The curved cut-out 164 facilitates the user's finger reaching in and pulling the literature-covering flap open to remove the literature.

Once the carton is closed with the product inside, the user will seek to open the carton. The other end flaps are of single thickness and will deform readily during opening, but the end flap 38 is essentially of double thickness and so is not at easily deformed and moved to an open position. To accommodate easier opening of the end flap 38, the opening 162 provides a space for the user's finger to engage the end of the closed flap and lift it to an open position.

When and if the literature is removed from the carton, the panel 38 can be folded into the carton. The panel 38 and the portion 152 lie against the interior surface of the side panel 30 and the end portion 156 is disposed against the inside of the opposite end of the carton, against the end formed by the closed flaps 12, 34, 52 and 72.

Embodiment #4

Figure 14:
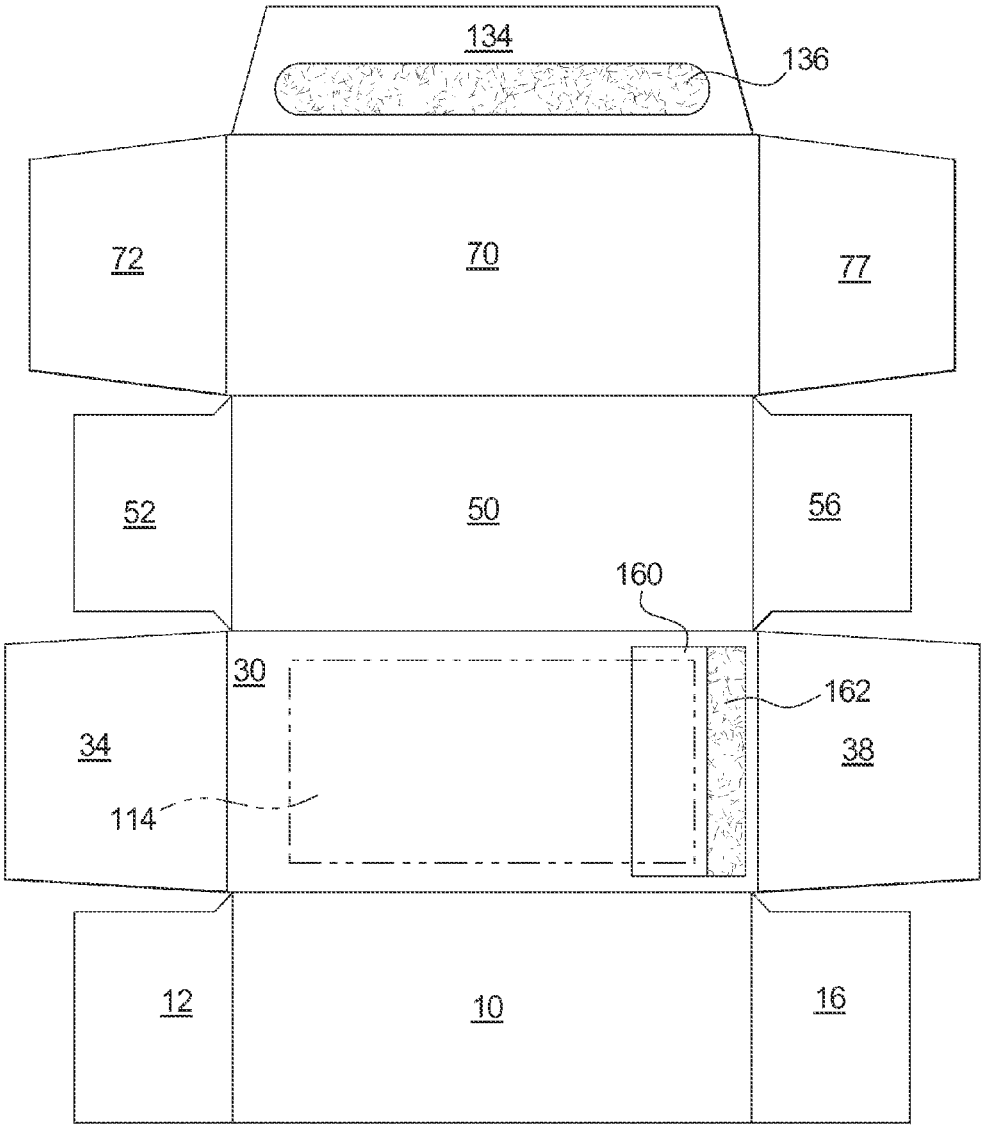
FIG. 14 is a layout view showing cut and fold locations of a flat carton that can be folded to form a carton with a location to attach literature.

FIGS. 14 through 16 illustrate another embodiment of a carton that simplifies the filling process by segregating the literature from the product, or more exactly shielding the product from the edge of the literature during product insertion. The configuration and assembly of side panels 10, 30, 50 and 70 are in many ways similar to those shown and described in embodiments 1, 2 and 3 above. Side flap 134 is attached through adhesive in region 136 to side panel 10, and the ends of the carton are closed by flaps 12, 16, 52, 56 and end panels 34, 38, 72, 77. In these aspects, the carton of this embodiment is the same as many known cartons. However, in embodiment 4, flap or label 160 is placed on side panel 30 and affixed to the side panel with a pressure-sensitive adhesive in region 162 so that the flap or label has a secured edge and a free edge, the free edge extending over the edge of the literature. Alternatively, full label adhesive may be deadened at the free edge portion to achieve a similar effect. Label or flap 160 may be made of paper, plastic or any other suitable material. Label or flap 160 acts as a ramp or separator for literature contained within the carton when product is inserted into the carton. The product that is placed in the carton will not catch or hit the literature during the filling procedure because label 160 prevents the product from contacting the edge of the literature.

Access to the literature by the user is facilitated by the user removing the label or flap 160 from the interior of the carton such as by pulling loose the adhesive 162 or by merely folding the free edge of the label or flap 160 upward to release the literature. The label or flap can be folded back once again to secure the literature when the user has finished with it.

Embodiment #5

Figure 17:
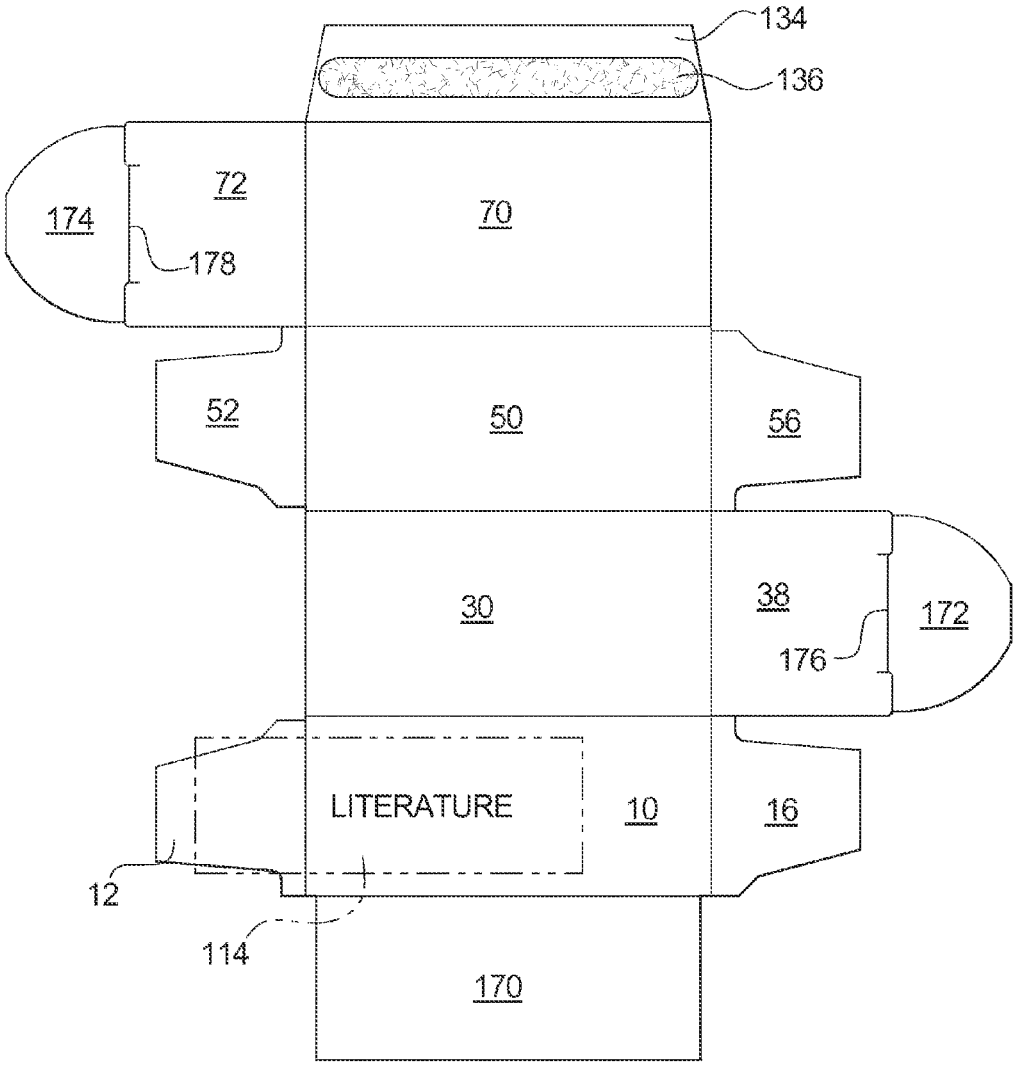
FIG. 17 is a layout view of a flat that has been cut and that can be folded to form an internal partition intended to hold attached literature away from product contact and interference during product filling.
Figure 18:
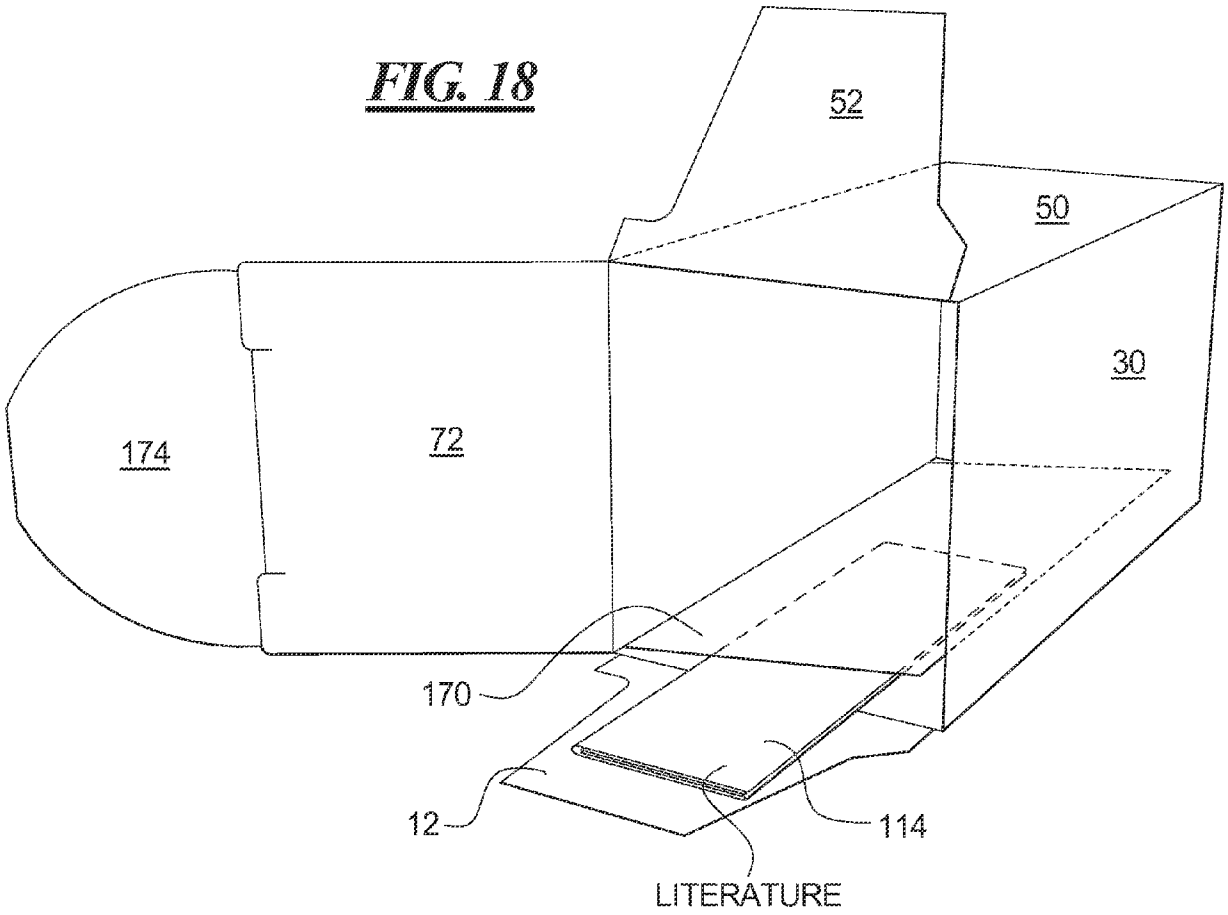
FIG. 18 is an isometric side view of the literature attached inside of the carton from the layout of FIG. 17 with the internal partition covering a portion of the literature but allowing a portion of the literature to present itself above the top of the formed carton so as to make it easier for the consumer to remove from the package.

FIGS. 17 and 18 illustrate yet another embodiment of a carton that simplifies the filling process. The configuration and assembly of side panels 10, 30, 50 and 70 are similar to those described with regard to embodiments 1, 2, 3 and 4 above. Side flap 134 is attached through adhesive in region 136 to side panel 10. In this embodiment, additional side panel 170 is disposed on assembly parallel and next to side panel 10 to cover the literature 114 which is positioned against the side panel 10. Flaps 12, 16, 52, 56 are similar to embodiment #1 through #4 above. However, end panels 38 and 72 contain extensions 172 and 174, and there is no opposing end panel on the other side of each of side panels 30 and 70. Extensions 172 and 174 are folded inwardly at fold lines 176 and 178 to form a right angle between end panel 38 and extension 172 and between end panel 72 and extension 174 and the extensions 172 and 174 are tucked into the ends of the carton, in a manner that is well known. In particular, in closing the end of the carton having end panel 38, first flaps 16 and 56 are folded inwardly so that they are perpendicular to the side panels, next end panel 38 is folded inwardly into a position perpendicular to the side panels while sliding extension 172 into the space between side panel 70 and additional side panel 170. Fold lines in this embodiment are provided with prebreak folds at 160 degrees and 120 degrees at two opposite corners to facilitate forming of the carton.

Next, literature 114 is inserted between the side panel 10 and the extra flap 170 so that it partially extends out of the carton as shown in FIG. 17. Literature 114 may be held in place with hot-melt non-fiber tearing glue such that when the customer opens the carton and grasps the end of the insert, the hot melt glue releases from the carton giving the user access to the literature. The literature extends up and onto flap 12 of the carton. This design allows for a bar code on the literature to be easily scanned by the customer/product manufacturer on their packaging lines since it is exposed on the outside of the carton, thereby assuring that the proper literature accompanies the product. Automated filing machines can insert the product, for example, by pushing the product against the side of the extended portion of the literature and pressing the literature sideways to move the literature out of the way prior to insertion of the product into the carton. After insertion of the customer product, the flaps are folded in as per the usual carton erection process and the attached literature becomes folded over the product. To finally close the carton, end panel 72 is folded inwardly over the end of the carton and extension 174 is folded into the interior of the carton adjacent to side panel 30.

The user has ready access to the literature without the literature being loose and in the way during insertion of the product into the carton. In each of the embodiments, the literature is held out of the way of automated product insertion.

The dimensions shown in the above embodiments are a matter of design choice depending on the ultimate size and shape of the carton required for the specific product that is ultimately going to be placed within the folded carton. Cutouts, relief sections, shoulder cutouts and the like may be chosen to facilitate the erection or closure of the cartons and various shapes and dimensions may be utilized to carry out the invention. Additionally, all of the above embodiments may be used with conventional carton filling machines. In these embodiments, the literature may be attached prior to the filling process.

Thus, there has been shown and described several alternative embodiments for placement of literature within a carton that aides in the automatic insertion process for customers' products. Although other modifications and changes may be suggested by those skilled in the art, it is the intention of the inventor to embody within the patent warranted hereon all changes and modifications as reasonably and properly come within the scope of his contribution to the art.

We claim:

1. A container thrilled from a continuous blank comprising:

a first rectangular side panel having at least one end panel formed on an end of the first rectangular side panel by a first fold line, and a side flap formed on a second side of the first rectangular side panel by a second fold line;

a second rectangular side panel perpendicular to and foldably attached to the first rectangular side panel by a third fold line, and having at least one end panel formed on an end of the second rectangular side panel by a fourth fold line;

a third rectangular side panel perpendicular to and foldably attached to the second rectangular side panel by a fifth fold line, and having at least one end panel formed on an end of the third rectangular side panel by a sixth fold line;

a fourth rectangular side panel perpendicular to and foldably attached to the third rectangular side panel by a seventh fold line, and having at least one end panel formed on an end of the fourth rectangular side panel by an eighth fold line;

a fifth rectangular panel perpendicular to and foldably attached to the fourth rectangular side panel by a ninth fold line;

a panel extension formed by a tenth fold line on a side of the fifth rectangular panel opposite the ninth fold line;

the side flap adhesively attached to the fourth rectangular side panel such that a portion the fourth rectangular side panel extends beyond the plane formed by the first rectangular panel;

the panel extension adhesively attached to the second rectangular side panel such that a portion of the panel extension extends beyond the plane formed by the first rectangular panel, wherein a space with open ends is formed between the fifth rectangular panel and the first rectangular panel; and literature adhesively attached within the space formed between the fifth rectangular panel and the first rectangular panel.

2. The container of claim 1 wherein the adhesive attaching the literature within the space formed between the fifth rectangular panel and first rectangular panel prevents fiber tear.

3. The container of claim 1 further comprising:

cut out sections along one or more fold lines between the rectangular panels and end panels.

4. The container of claim 1 where the panel extension is adhesively attached to the second rectangular side panel at two locations separated by a tab, with perforations between the tab and two adhesively attached locations, whereby the panel extension having the tab may be opened by tearing along the perforations.

5. The container of claim 4 further comprising:

a slit in the second rectangular panel configured such that the tab of the panel extension may be inserted into the slit to reclose the panel extension.

6. The container of claim 1 further comprising:

perforations along the second fold line between the side flap and the first rectangular side panel; and a cutout in the first rectangular side panel adjacent the perforations;

wherein the first rectangular side panel may be separated from the side flap along the perforations and cutout to permit access to the interior of the carton.

7. The container of claim 1 where one or more end panels have, relieved sections to facilitate closing of the container.

* * * * *